US005579668A

United States Patent [19]

Kozak

[11] Patent Number: 5,579,668

[45] Date of Patent: Dec. 3, 1996

[54] MULTI-FUNCTION SCREWDRIVER

[76] Inventor: Burton Kozak, 1300 N. Lake Shore Dr., #28C, Chicago, Ill. 60610

[21] Appl. No.: 527,507

[22] Filed: Sep. 13, 1995

Related U.S. Application Data

[63] Continuation of Ser. No. 168,029, Dec. 15, 1993, abandoned.

[51] Int. Cl.[6] ..... B25B 23/00

[52] U.S. Cl. ..... 81/439; 81/438

[58] Field of Search ..... 81/438, 439

[56] References Cited

U.S. PATENT DOCUMENTS

| | | | |
|---|---|---|---|
| 686,424 | 11/1901 | Smith | 81/439 X |
| 2,022,775 | 12/1935 | Holland-Letz | 81/439 |
| 4,235,133 | 11/1980 | Acevedo . | |
| 4,848,197 | 7/1989 | Kikel | 81/438 X |
| 5,179,748 | 1/1993 | Lipic | 81/439 X |

FOREIGN PATENT DOCUMENTS

| | | | |
|---|---|---|---|
| 403769 | 1/1934 | United Kingdom | 81/439 |

OTHER PUBLICATIONS

"Consolidated Tool Works Screwdriver Set"; American Machinist; Nov. 24, 1921; p. 863.

*Primary Examiner*—James G. Smith

*Attorney, Agent, or Firm*—Marshall, O'Toole, Gerstein, Murray & Borun

[57] ABSTRACT

In order to enhance the availability of tools, a multifunction screwdriver has a handle with first and second ends that support a pair of removable and reversible screwdriver tips therein. The handle has first and second axial bores in each of the ends with the second bores of a greater diameter but lesser depth than the corresponding ones of the first bores. The second bores in the handle each have a bushing disposed therein which is suitably sized and configured for axial and radial retention. The removable and reversible screwdriver tips are each operatively associated with one of the first and second ends of the handle. The screwdriver tips each have an elongated shank of non-circular cross-section and a driving tip on each of opposite ends thereof. The bushings also each have an inner surface of non-circular cross-section for receiving at least one of the screwdriver tips therein. With this arrangement, the bushings are sized and shaped to transmit torque applied to the handle to fasteners through the elongated shanks and the driving tips of the removable and reversible screwdriver tips.

13 Claims, 1 Drawing Sheet

MULTI-FUNCTION SCREWDRIVER

This is a Rule 62 file wrapper continuation of U.S. application Ser. No. 08/168,029, filed Dec. 15, 1993, now abandoned.

FIELD OF THE INVENTION

The present invention is generally related to tools and, more particularly, a multi-function screwdriver that can be carried in a shirt pocket.

BACKGROUND OF THE INVENTION

From the earliest times in recorded history, there have been continuing efforts to develop the tools that could ease the burdens of mankind. Initially, such tools were very primitive but, in recent years, both manual and powered tools have become much more sophisticated and specialized to address the widely varying needs that are faced in modern life. However, while such tools have been highly beneficial, there have remained a number of vexing problems of rather significant proportions.

As a matter of fact, the very development of such specialized tools has, ironically, turned out to be nothing more than a mixed benefit. On the one hand, it has facilitated the ability to complete a wide range of different tasks but, on the other hand, the sheer number of tools which is required today is oftentimes staggering and expensive. On the down side, even if one has all of the tools that are required to complete a given task, there can be practical problems in their use.

More specifically, it is sometimes difficult to find a needed tool due to the sheer number of tools that must be owned. There is also another problem in that switching from one tool to another can be time consuming and frustrating, particularly if the worker is in a position of limited access where it is impossible to maintain in close proximity all of the tools that may be needed to perform a particular task. In fact, this can in some instances actually pose not only an unwanted hindrance to completing a task but also a safety hazard.

In line with the present invention, it is very well known that there exists a wide variety of fasteners, and sizes of fasteners, that are available for a multitude of different purposes. It is oftentimes the case that a worker will need to be installing and/or removing fasteners of different types and sizes in rapid succession, and this also frequently occurs in many instances at a time when a worker is not at or near a supply of tools such as a tool box or the like. For this purpose, it would be highly desirable to have a multi-function screwdriver that could be carried in a shirt pocket to successfully accomplish this objective in a highly effective manner.

The present invention is directed to overcoming one or more of the foregoing problems and achieving one or more of the resulting objects.

SUMMARY OF THE INVENTION

It is therefore a principal object of the present invention to enhance availability of tools thereby to achieve greater worker efficiency. It is a further object of the present invention to provide a unique multi-function screwdriver that can be utilized for a variety of different fastener installing and removing applications and the like. It is an additional object of the present invention to provide a unique screwdriver that is specifically adapted to be carried in a shirt pocket.

Accordingly, the present invention is directed to a multi-function screwdriver having a handle with a first end and a second end in axially spaced relation and a pair of removable and reversible screwdriver tips. The handle has a first axially extending bore in each of the ends thereof and a second axially extending bore also in each of the ends thereof. The second bores are of a diameter greater than the diameter of the corresponding one of the first bores and of a depth less than the depth of the corresponding one of the first bores. The handle further includes a bushing disposed in each of the second axially extending bores. The bushings each have means associated with an outer surface for axially and radially retaining the bushing in the corresponding one of the second axially extending bores. With this arrangement, the removable and reversible screwdriver tips are each operatively associated with one of the first and second ends of the handle and, more specifically, the bushings in the second axially extending bores.

More specifically, the screwdriver tips each have an elongated shank of non-circular cross-section and a driving tip on each of opposite ends of the screwdriver tips for installing and removing fasteners. The bushings also each have an inner surface of non-circular cross-section for receiving at least one of the screwdriver tips therein. With this construction, the bushings are sized and shaped to transmit torque applied to the handle to fasteners through the elongated shanks and the driving tips of the removable and reversible screwdriver tips.

In the exemplary embodiment, the first axially extending bores each have a diameter for receiving the elongated shank of at least one of the screwdriver tips in interference fit fashion for retention thereof. In a further respect, the first axially extending bores also each are of a length to allow one end of at least one of the screwdriver tips to be operable on fasteners when the other end is fully inserted thereinto.

In a highly preferred embodiment, the means associated with the outer surface of the bushings includes axially extending grooves for press fit installation of the bushings into the second axially extending bores. It is also advantageous for the elongated shanks of the screwdriver tips to each be generally hexagonal in cross-section and for the bushings each to have a hexagonal shaped opening for receiving at least one of the screwdriver tips. With this construction, the bushings are well suited for transmitting torque applied to the handle to fasteners through the elongated shanks and the driving tips of the removable and reversible screwdriver tips.

As for other aspects of the present invention, the handle preferably has a generally square shaped transverse cross-section and includes a pocket clip on a flat surface adjacent one of the first and second ends thereof. It is also highly advantageous for one of the screwdriver tips to be of a first length and the other of the screwdriver tips to be of a second, longer length with the first axially extending bores being of equal length. With this arrangement, the shorter screwdriver tip is insertable into the end of the handle adjacent the pocket clip, and a removable protective cap may advantageously be placed over an end of that particular screwdriver tip.

Other objects, advantages and features of the present invention will become apparent from a consideration of the following specification taken in conjunction with the accompanying drawings.

DETAILED DESCRIPTION OF THE PREFERRED EMBODIMENT

Figure 1:
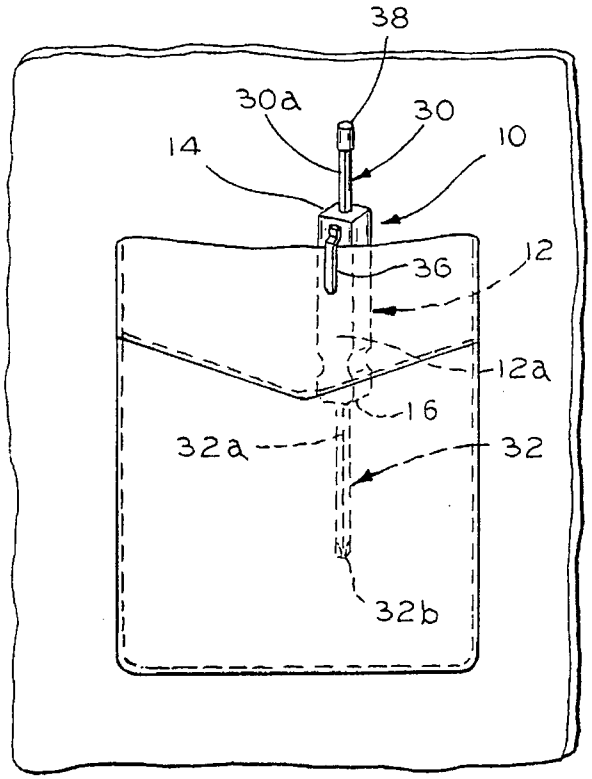
FIG. 1 is a perspective view of a multi-function screwdriver in a shirt pocket in accordance with the present invention.

In the illustrations given, and with reference first to FIG. 1, the reference numeral 10 designates generally a multi-function screwdriver in accordance with the present invention having a handle 12 with a first end 14 and a second end 16 in axially spaced relation. The handle 12 also has a first axially extending bore 18 in each of the first and second ends 14 and 16 and a second axially extending bore 20, also in each of the first and second ends 14 and 16. The second axially extending bores 20 are each of a diameter greater than the diameter of the corresponding one of the first axially extending bores 18 and of a depth less than the depth thereof. Still additionally, the multi-function screwdriver 10 will be seen from FIG. 2 to include a bushing 22 which is suitably disposed in each of the second axially extending bores 20 in the handle 12.

Figure 2:
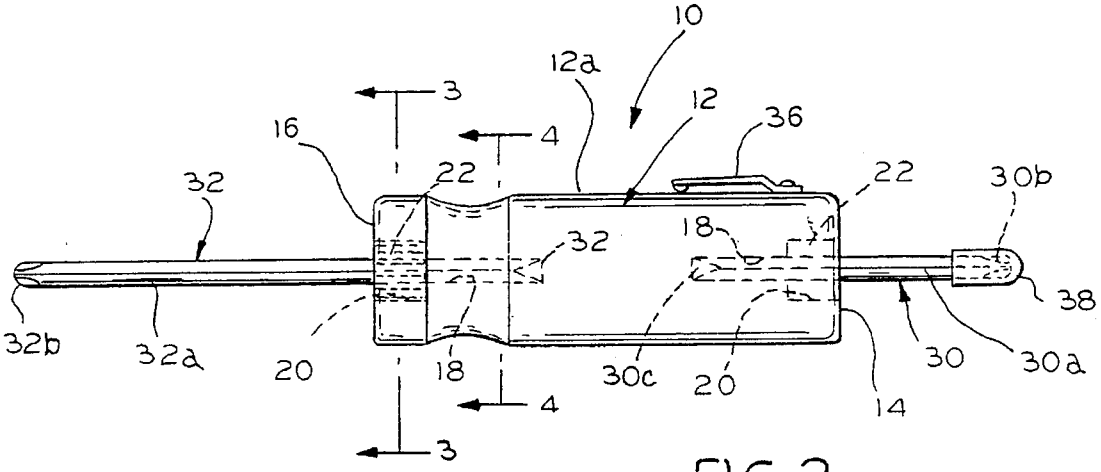
FIG. 2 is a right side elevational view of the multi-function screwdriver of FIG. 1.
Figure 3:
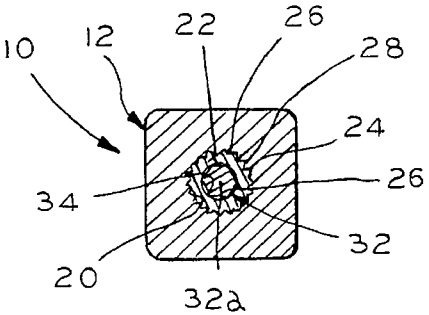
FIG. 3 is a cross-sectional view taken on the line 3—3 of FIG. 2.

As best shown in FIGS. 2 and 3, the bushings 22 each have means associated with an outer surface 24 thereof for axially and radially retaining them in the corresponding ones of the second axially extending bores 20. More specifically, the retaining means comprises serrations in the form of axially extending grooves 26 which create axially extending points 28 for press fit installation of the bushings 22 into the second axially extending bores 20. As will be appreciated, the bushings 22 are suitably sized and shaped to be able to transmit torque applied to the handle 12 to fasteners through one of a pair of removable and reversible screwdriver tips 30 and 32.

Figure 4:
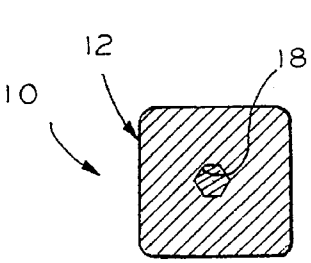
FIG. 4 is a cross-sectional view taken on the line 4—4 of FIG. 2.

In this connection, and referring to FIGS. 2–4, the removable and reversible screwdriver tips 30 and 32 include one operatively associated with each of the first and second ends 14 and 16 of the handle 12. The screwdriver tips 30 and 32 each have an elongated shank 30*a* and 32*a* of non-circular cross-section and a driving tip 30*b*, 30*c* and 32*b*, 32*c* on each of opposite ends of the respective elongated shanks 30*a* and 32*a* for installing and removing fasteners. As will be appreciated by referring to FIG. 3, the bushings 22 each are configured to have an inner surface 34 of a corresponding non-circular cross-section for receiving at least one of the screwdriver tips 30 and 32.

Referring to FIGS. 2 and 4, the first axially extending bores 18 will each be seen to have a diameter for receiving the elongated shank 30*a* or 32*a* of at least one of the screwdriver tips 30 or 32 in interference fit fashion for axial retention thereof. In addition, the first axially extending bores 18 will each be seen to have a length to allow one end 30*b* or 30*c*, 32*b* or 32*c* of at least one of the screwdriver tips 30 or 32 to be operable on fasteners when the opposite end is fully inserted thereinto. Still additionally, and as best shown in FIGS. 3 and 4, the elongated shanks 30*a* and 32*a* of the screwdriver tips 30 and 32 are each generally hexagonal in cross-section with the bushings 22 each having a corresponding hexagonally shaped opening defined by the inner surface 34 thereof.

Referring to FIGS. 2–4, the handle 12 will be understood to have a generally square shaped transverse cross-section and to include a pocket clip 36 on a generally flat surface 12*a* of the handle 12 adjacent one of first and second ends 14 and 16 thereof. It will also be appreciated from FIG. 2 that one of the screwdriver tips 30 and 32, i.e., the tip 30, is of a first, shorter length and the other of the screwdriver tips, i.e., the tip 32, is of a second, longer length and, additionally, the first axially extending bores 18 are preferably of equal length. With this arrangement, the handle 12 preferably has the pocket clip 36 on the surface 12*a* adjacent the first end 14 thereof and the screwdriver tip 30 of the first, shorter length is insertable into the end 14 of the handle 12 generally adjacent the pocket clip 36.

In a highly preferred embodiment of the invention, the handle 12 is approximately 2¾ inches in length and 1 inch along each side in transverse cross-section. Also, each of the first axially extending bores 18 is approximately 1 inch in length, and it has been found advantageous for the shorter screwdriver tip 30 to be approximately 2 inches in length with the longer screwdriver tip 32 being approximately 3¼ inches in length. With this arrangement, it will be understood and appreciated that the overall length of the multi-function screwdriver 10 is approximately 6 inches.

As for other details, a removable protective cap 38 is advantageously provided for placement over the exposed end of the screwdriver tip 30 which projects from the first end 14 of the handle 12 near the pocket clip 36. In the preferred embodiment of the invention, the removable protective cap is formed of plastic and will be a maximum of ½ inch in length to protect the person carrying the multi-function screwdriver 10.

Still additionally, the bushings 22 are preferably formed to have an outer diameter of approximately ¼ inch, a maximum length of approximately ¼ inch, and hex openings of approximately ⅛ inch from flat-to-flat with the hex shanks of the screwdriver tips also being approximately ⅛ inch from flat-to-flat. Further, the first and second axially extending bores are approximately ⅛ inch and ¼ inch in diameter, respectively. As will be appreciated, the actual diameter of the first and second axially extending bores will be selected so that the first bores will each serve an axial retention function for the screwdriver tips, and the second bores will each serve axial and radial retention functions with respect to the bushings that are press fit thereinto as described hereinabove.

While in the foregoing there has been set forth a preferred embodiment of the invention for purposes of illustration, the details herein given may be varied by those skilled in the art without departing from the true spirit and scope of the appended claims.

What is claimed is:

1. A multi-function screwdriver, comprising:

a handle having a first end and a second end in axially spaced relation, said handle having a first axially extending bore in each of said first and second ends and a second axially extending bore in each of said first and second ends of a diameter greater than the diameter of the corresponding one of said first axially extending bores and of a depth less than the depth of the corresponding one of said first axially extending bores, and a bushing disposed in each of said second axially extending bores;

said bushings each having means associated with an outer surface thereof for axially and radially retaining said bushing in the corresponding one of said second axially extending bores;

a first screwdriver tip removably and reversibly associated with said first end of said handle and a second screwdriver tip removably and reversibly associated with said second end of said handle, said screwdriver tips simultaneously projecting from the respective ones of said first and second ends of said handle in both a storage and use position and each having an elongated shank of non-circular cross section and a driving tip on each of opposite ends of said elongated shanks such that either one of said first and second screwdriver tips is operable for installing and removing fasteners with selected ones of said driving tips extending from the corresponding ones of said first and second ends of said handle, said bushings each having an inner surface of non-circular cross-section for receiving the corresponding one of said first and second screwdriver tips;

said bushings being sized and shaped to transmit torque applied to said handle to fasteners through said elongated shanks and said driving tips thereon;

one of said first and second screwdriver tips projecting from said handle by a first, shorter distance and the other of said first and second screwdriver tips projecting from said handle by a second, longer distance, said handle having a pocket clip on a surface adjacent said first end thereof, said screwdriver tip nearest said pocket clip projecting from said first end of said handle by said first, shorter distance and said screwdriver tip remote from said pocket clip projecting from said second end of said handle by said second, longer distance, said screwdriver tips each having an exposed length that is always the same regardless of which of its driving tips extends from said handle such that the ratio of one of said screwdriver tips to the other is always the same.

2. The multi-function screwdriver of claim 1 wherein said first axially extending bores each have a diameter for receiving said elongated shank of at least one of said screwdriver tips in interference fit fashion for retention thereof.

3. The multi-function screwdriver of claim 1 wherein said first axially extending bores each have a length to allow one end of at least one of said screwdriver tips to be operable on fasteners when the other end is fully inserted thereinto.

4. The multi-function screwdriver of claim 1 wherein said means associated with said outer surface of said bushings includes axially extending grooves for press fit installation of said bushings into said second axially extending bores.

5. The multi-function screwdriver of claim 1 wherein said elongated shanks of said screwdriver tips each are generally hexagonal in cross-section and said bushings each have a hexagonal shaped opening for receiving at least one of said screwdriver tips.

6. A multi-function screwdriver, comprising:

a handle having a first end and a second end in axially spaced relation, said handle having a first axially extending bore in each of said first and second ends and a second axially extending bore in each of said first and second ends of a diameter greater than the diameter of the corresponding one of said first axially extending bores and of a depth less than the depth of the corresponding one of said first axially extending bores, and a bushing disposed in each of said second axially extending bores;

said bushings each having means associated with an outer surface thereof for axially and radially retaining said bushing in the corresponding one of said second axially extending bores;

a first screwdriver tip removably and reversibly associated with said first end of said handle and a second screwdriver tip removably and reversibly associated with said second end of said handle, said screwdriver tips simultaneously projecting from said first and second ends of said handle in both a storage and use position and each having an elongated shank of non-circular cross-section and a driving tip on each of opposite ends of said elongated shanks such that either one of said first and second screwdriver tips is operable for installing and removing fasteners with selected ones of said driving tips extending from the corresponding ones of said first and second ends of said handle, said bushings each having an inner surface of non-circular cross-section for receiving the corresponding one of said first and second screwdriver tips;

said first axially extending bores each having a diameter for receiving said elongated shank of at least one of said screwdriver tips in interference fit fashion for retention thereof, said first axially extending bores each having a length to allow one end of at least one of said screwdriver tips to be operable on fasteners when the other end is fully inserted thereinto;

said bushings being sized and shaped to transmit torque applied to said handle to fasteners through said elongated shanks and said driving tips thereon;

one of said first and second screwdriver tips projecting from said handle by a first, shorter distance and the other of said first and second screwdriver tips projecting from said handle by a second, longer distance, said handle having a pocket clip on a surface adjacent said first end thereof, said screwdriver tip nearest said pocket clip projecting from said first end of said handle by said first, shorter distance and said screwdriver tip remote from said pocket clip projecting from said second end of said handle by said second, longer distance, said screwdriver tips each having an exposed length that is always the same regardless of which of its driving tips extends from said handle such that the ratio of one of said screwdriver tips to the other is always the same.

7. The multi-function screwdriver of claim 6 wherein said means associated with said outer surface of said bushings includes axially extending grooves for press fit installation of said bushings into said second axially extending bores.

8. The multi-function screwdriver of claim 6 wherein said elongated shanks of said screwdriver tips each are generally hexagonal in cross-section and said bushings each have a hexagonal shaped opening for receiving at least one of said screwdriver tips.

9. The multi-function screwdriver of claim 6 wherein said handle has a generally square shaped transverse cross-section and said pocket clip is provided on a flat surface of said handle adjacent one of said first and second ends thereof.

10. The multi-function screwdriver of claim 6 wherein one of said screwdriver tips is of a first length and the other of said screwdriver tips is of a second, longer length and said first axially extending bores are of equal length.

11. A multi-function screwdriver, comprising:

a handle having a first end and a second end in axially spaced relation, said handle having a first axially extending bore in each of said first and second ends and a second axially extending bore in each of said first and second ends of a diameter greater than the diameter of the corresponding one of said first axially extending bores and of a depth less than the depth of the corresponding one of said first axially extending bores, and a bushing disposed in each of said second axially extending bores;

said bushings each having means associated with an outer surface thereof for axially and radially retaining said bushing in the corresponding one of said second axially extending bores;

a first screwdriver tip removably and reversibly associated with said first end of said handle and a second screwdriver tip removably and reversibly associated with said second end of said handle, said screwdriver tips simultaneously projecting from said first and second ends of said handle in both a storage and use position and each having an elongated shank of non-circular cross-section and a driving tip on each of opposite ends of said elongated shanks such that either one of said first and second screwdriver tips is operable for installing and removing fasteners with selected ones of said driving tips extending from the corresponding ones of said first and second ends of said handle, said bushings each having an inner surface of non-circular cross-section for receiving the corresponding one of said first and second screwdriver tips;

said first axially extending bores each having a diameter for receiving said elongated shank of at least one of said screwdriver tips in interference fit fashion for retention thereof, said first axially extending bores each having a length to allow one end of at least one of said screwdriver tips to be operable on fasteners when the other end is fully inserted thereinto;

said bushings being sized and shaped to transmit torque applied to said handle to fasteners through said elongated shanks and said driving tips thereof, said elongated shanks of said screwdriver tips each being generally hexagonal in cross-section and said bushings each having a hexagonal shaped opening for thereby receiving and driving at least one of said screwdriver tips, and said means associated with said outer surface of said bushings includes axially extending grooves for press fit installation into said second axially extending bores;

one of said first and second screwdriver tips projecting from said handle by a first, shorter distance and the other of said first and second screwdriver tips projecting from said handle by a second, longer distance and said first axially extending bores being of equal length, said handle having a pocket clip on a surface adjacent said first end thereof, said screwdriver tip nearest said pocket clip projecting from said first end of said handle by said first, shorter distance and said screwdriver tip remote from said pocket clip projecting from said second end of said second end of said handle by said second, longer distance, said screwdriver tips each having an exposed length that is always the same regardless of which of its driving tips extends from said handle such that the ratio of one of said screwdriver tips to the other is always the same.

12. The multi-function screwdriver of claim 11 wherein said handle has a generally square shaped transverse cross-section and said pocket clip is provided on a flat surface of said handle adjacent one of said first and second ends thereof.

13. The multi-function screwdriver of claim 11 including a removable protective cap for placement over an end of said one of said first and second screwdriver tips of said first, shorter length projecting from said first end of said handle adjacent said pocket clip.

* * * * *